US005531620A

United States Patent [19]

Ozawa et al.

[11] Patent Number: 5,531,620

[45] Date of Patent: Jul. 2, 1996

[54] WATER-COOLED EXHAUST SYSTEM FOR WATERCRAFT

[75] Inventors: Shigeyuki Ozawa; Ryoichi Nakase, both of Hamamatsu, Japan

[73] Assignee: Sanshin Industries Co., Ltd., Hamamatsu, Japan

[21] Appl. No.: 349,680

[22] Filed: Dec. 5, 1994

[30] Foreign Application Priority Data

Dec. 6, 1993 [JP] Japan ..... 5-305484

[51] Int. Cl.[6] ..... B63H 21/32

[52] U.S. Cl. ..... 440/89; 440/88; 60/310

[58] Field of Search ..... 440/88, 89; 60/310, 60/320, 321; 165/51

[56] References Cited

U.S. PATENT DOCUMENTS 3,921,398 11/1975 Kashmerick ..... 440/89

4,831,822 5/1989 Yoshimura ..... 440/89

*Primary Examiner*—Jesus D. Sotelo

*Attorney, Agent, or Firm*—Knobbe, Martens, Olsen & Bear

[57] ABSTRACT

Two embodiments of exhaust systems for small watercraft that include cooling jackets circling a portion of the exhaust conduit. At least a portion of the water from the cooling jacket is mixed with the exhaust gases but at a point spaced substantially downstream of the cooling jacket so as to reduce the likelihood of water entering the engine through the exhaust system. In one embodiment, an additional cooling jacket is provided to which the coolant from the first cooling jacket is introduced and then discharged into the exhaust conduit. The second cooling jacket is disposed substantially downstream of the first cooling jacket.

25 Claims, 6 Drawing Sheets

WATER-COOLED EXHAUST SYSTEM FOR WATERCRAFT

BACKGROUND OF THE INVENTION

This invention relates to a water-cooled exhaust system for a watercraft and more particularly to an improved system of this type that will ensure adequate cooling and prevent against the likelihood of water entering the engine through its exhaust system.

As is well known, the treatment of the exhaust gases from the powering internal combustion engine of a watercraft present a number of problems. With many types of watercraft, such as small personal watercraft, the watercraft is very compact in nature and the length of the exhaust system may not be adequate to afford sufficient silencing of the exhaust gases. In addition, because the exhaust system passes in substantial part through the hull of the watercraft, it is also desirable to ensure that the exhaust system is adequately cooled. Frequently, flexible pipes are employed in the exhaust system for vibration absorption and to permit relative thermal expansion. These flexible pipes are not able to withstand the temperature of the exhaust gases as they exit the engine. Therefore, it is desirable to ensure-that the exhaust gases are adequately cooled. In addition to the cooling of the exhaust system, the cooling of the exhaust gases also adds to their silencing.

For these reasons, it has been the practice to provide a cooling jacket around a portion or portions of the exhaust system. This cooling jacket frequently receives coolant from the engine cooling jacket or from the body of water in which the watercraft is operating for its cooling purposes. Rather than circulating this cooling water through a heat exchanger, as is typical with land vehicles, the water is normally returned back to the body of water in which the watercraft is operated. Frequently, this is done by discharging the water from the cooling jackets into the exhaust conduit which is cooled so that it will pass to the atmosphere along with the exhaust gases.

Although this type of system has the advantages of simplicity and additional cooling of the exhaust gases, it raises a possibility that water may flow backwardly through the exhaust conduit to the engine through the exhaust ports. This is obviously not desirable.

It is, therefore, a principal object of this invention to provide an improved exhaust system for a watercraft.

It is a further object of this invention to provide an improved water-cooled exhaust system for a watercraft wherein at least a portion of the cooling water is discharged into the atmosphere with the exhaust gases flowing through the exhaust conduit.

It is a further object of this invention to provide an improved water-cooled exhaust system for a watercraft that will ensure that water cannot enter the engine through the exhaust system.

One way in which the exhaust system is cooled is to provide a cooling jacket around at least a portion of the exhaust conduit. Frequently, this cooling jacket is formed by using a double-wall pipe section with an inner member, an outer member spaced from the inner member and the space therebetween forms the cooling jacket. It has been the normal practice to terminate the length of the inner member short of the length of the outer member with this area where the lengths differ being the point where water is discharged from the cooling jacket into the exhaust conduit. However, this is a point where water could enter the engine through the exhaust system.

It is, therefore, a still further object of this invention to provide an exhaust system having a cooling jacket formed by a double wall pipe section and wherein the water from the double wall pipe section is introduced into the exhaust conduit but well downstream of the end of the inner member.

SUMMARY OF THE INVENTION

A first feature of this invention is adapted to be embodied in an exhaust system for a watercraft that is powered by a water-cooled internal combustion engine having at least one exhaust port. An exhaust conduit extends from the exhaust port through the hull to an outlet for discharge of exhaust gases from the engine to the atmosphere. The exhaust conduit has a double-walled portion with the area between the double walls forming a cooling jacket through which water is circulated. The inner member of the double-walled portion forms an exhaust flow path through which exhaust gases pass in the path from the exhaust port to the outlet. The downstream end of the inner member terminates short of the outer member so that a portion of the outer member extends beyond the downstream end of the inner member. Seal means are provided for sealing at least the portion of the cooling jacket adjacent the downstream end of the inner member. Means are provided for discharging water from the cooling jacket into the exhaust conduit downstream of the inner member downstream end.

Another feature of the invention is adapted to be embodied in an exhaust system for a watercraft that is formed by a water-cooled internal combustion engine having at least one exhaust port. An exhaust conduit extends from the exhaust port through the hull to an outlet for discharge of the exhaust gases from the engine to the atmosphere. The exhaust conduit has a double-walled portion with the area between the double walls forming a cooling jacket through which water is circulated. The inner member of the double wall portion forms an exhaust flow path through which the exhaust gases pass in their path from the exhaust port to the outlet. Means form a seal between the inner and outer members at the downstream end of the cooling jacket. Means are provided for returning at least a portion of the water from the cooling jacket to the exhaust conduit downstream of the seal.

DETAILED DESCRIPTION OF THE PREFERRED EMBODIMENTS OF THE INVENTION

Figure 1:
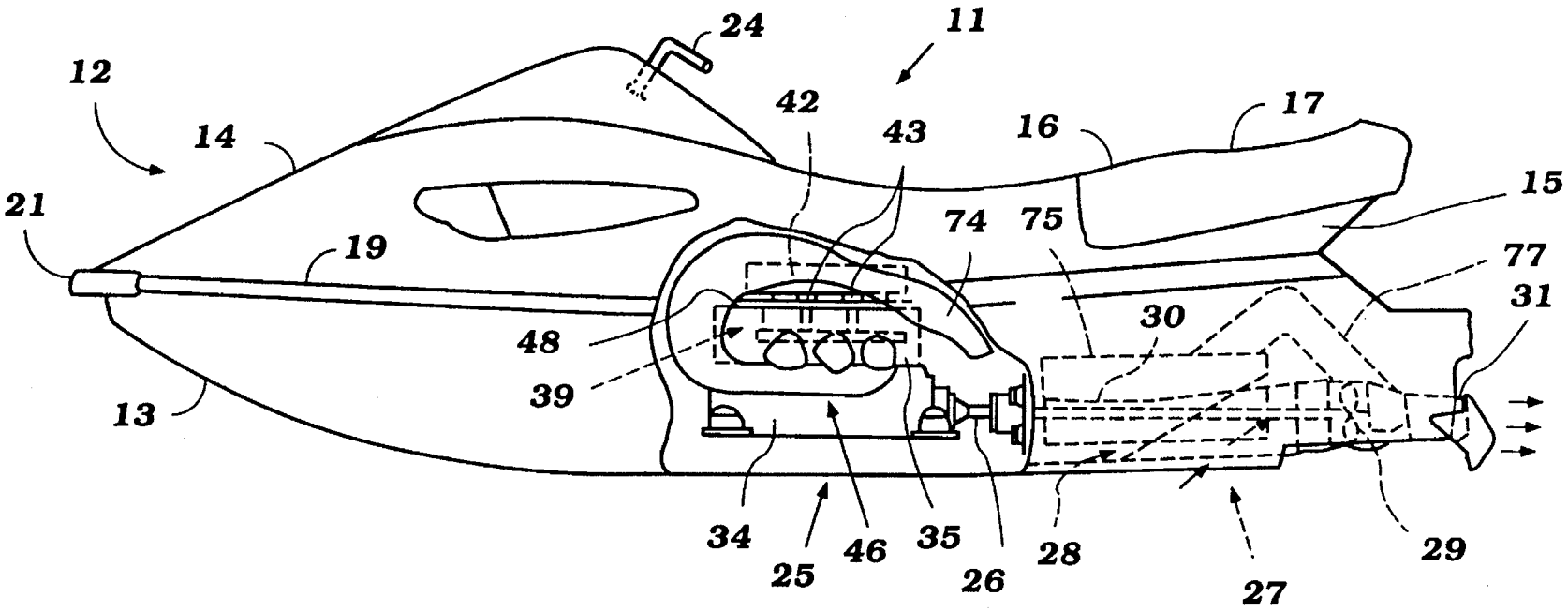
FIG. 1 is a side elevational view of a personal watercraft constructed in accordance with a first embodiment of the invention, with a portion broken away.
Figure 2:
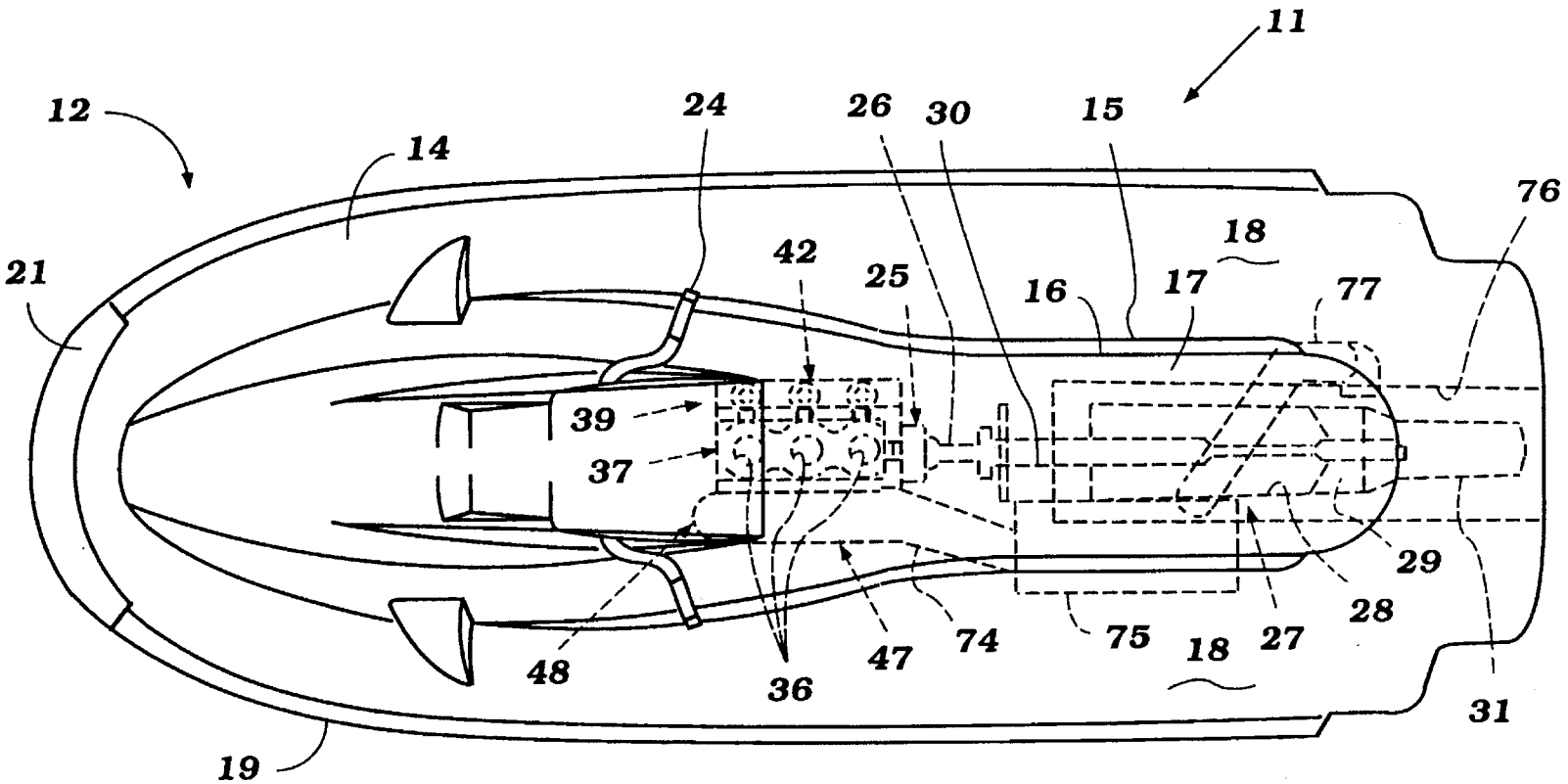
FIG. 2 is a top plan view of the watercraft.

Referring now in detail to the drawings and initially primarily to FIGS. 1 and 2, a small personal watercraft constructed in accordance with an embodiment of the invention is identified generally by the reference numeral 11. The particular configuration of the watercraft 11 that is depicted in the drawings may be considered to be typical of those types of watercraft with which the invention may be employed. It will be readily apparent, however, to those skilled in the art that the invention may be utilized with a wide variety of types of watercraft differing from that of the configuration depicted. In addition, although the invention is particularly adapted for use with personal watercraft, it will also become apparent to those skilled in the art that the invention, or at least certain facets of it, may be utilized with a wide variety of types of watercraft other than personal watercraft.

The watercraft 11 is comprised of a hull assembly, indicated generally by the reference numeral 12, which is made up of a lower hull part 13 and an upper deck part 14. The material from which the hull 12 is formed may be of any type of material normally employed in this type of watercraft; for example, a fiberglass reinforced resin or the like.

To the rear of the hull 12 there is provided a passenger's area which is defined in part by a raised hull portion 15 upon which a seat, indicated generally by the reference numeral 16, is provided. The seat 16 has a generally longitudinally extending portion 17 which is cushioned and which is designed so as to accommodate one or more riders seated in straddle fashion. Where more than one rider is accommodated, they are seated in tandem fashion.

A pair of foot areas 18 are formed on opposite sides of the raised deck portion 15 and provide areas upon which the seated riders may place their feet. It should be noted that the area outside of the foot areas 18 is encompassed by a raised area 22 that is defined in part by a gunnel 19 that extends generally around the perimeter of the hull 12 and which may be formed at the area where the hull portion 13 and deck portion 14 are connected to each other. A bumper 21 is placed at the front of the hull 12.

As is also typical with this type of watercraft, the foot areas 18 extend generally rearwardly through an open area at the transom of the watercraft so that the watercraft may easily be boarded at the rear from the body of water in which the watercraft is operated.

The watercraft 11, and particularly its propulsion unit, is controlled by means of a handlebar assembly 24 that is positioned immediately forwardly of the seat 16. This handlebar assembly includes an arrangement for steering of the watercraft 11, as will be described, a throttle control, and other controls, as are well known in the art.

The area beneath the forward portion of the deck 14 and extending at least in substantial part below the forward portion of the seat 16 forms an engine compartment in which an internal combustion engine, indicated generally by the reference numeral 25, is provided for powering of the watercraft. The engine 25 is, in the illustrated embodiment, depicted as being a three-cylinder, in-line, crankcase compression, two-cycle internal combustion engine. It will be readily apparent to those skilled in the art, however, how the watercraft 11 may be propelled by a wide variety of types and configurations of engines.

Continuing to refer to FIGS. 1 and 2, the engine 25 has its output shaft connected to a drive shaft 26 that extends rearwardly and which drives a jet propulsion unit, indicated generally by the reference numeral 27, which is positioned to the rear of the hull 12 for propelling the watercraft 11. The jet propulsion unit 27 may be disposed in substantial part within a tunnel formed at the rear of the hull portion 13.

The jet propulsion unit is of any known type and is depicted as having a downwardly facing water inlet portion 28 that opens through a corresponding opening in the underside of the hull 13. Water is drawn through this water inlet portion 28 by means of an impeller 29 that is fixed to an impeller shaft 30 which is, in turn, drivingly coupled to the drive shaft 26. This water is then discharged rearwardly back to the body of water in which the watercraft is operating through a steering nozzle 31 which is coupled to the handlebar assembly 24 for steering of the watercraft in a manner well known in this art.

The area of the engine compartment forward of the engine 25 may include a fuel tank (not shown) which has a fill neck disposed at one side or centrally in the forward portion of the deck 14. This fuel tank supplies fuel to the engine 25 in a manner well known in this art.

The construction of the watercraft 11 as thus far described may be considered to be conventional, and for that reason, any components which have not been described may be considered to be conventional, and further description of these conventional components is not believed to be necessary to understand the construction and operation of the invention.

Although the construction of the engine 25 may be considered to be conventional, certain components of the engine 25 will be described inasmuch as the layout of certain of the components and auxiliaries for the engine 25 and their construction is important in the invention. The engine 25 is comprised of a crankcase assembly 34 (FIGS. 1–3) in which the engine output shaft (a crankshaft) that is coupled to the drive shaft 26 is rotatably journaled. A cylinder block 35 extends vertically upwardly from the crankcase 34 and contains the cylinders of the engine. As has been noted in the illustrated embodiment, the engine 25 is of the three-cylinder in-line type and its cylinder bores are shown in phantom in FIG. 2 and are identified by the reference numerals 36. A cylinder head 37 is affixed to the upper end of the cylinder block 35 and closes these cylinder bores. The engine spark plugs (not shown) are mounted in the cylinder head 37 in a well-known manner and are fired by a suitable ignition system.

As is well known in two-cycle crankcase engine practice, the crankcase chambers formed by the crankcase assembly 34 of the engine are sealed from each other. An intake charge is delivered to these crankcase chambers for compression and transfer to the cylinder bores 36. An induction system, indicated generally by the reference numeral 39, is provided on one side of the engine for this charge introduction and charge forming. This induction system 39 includes an atmospheric air inlet 41 which draws atmospheric air from within the engine compartment and which is curved to face downwardly so as to ensure against the ingestion of water into the induction system. The air inlet 41 communicates with a plenum chamber 42 which, in turn, delivers the air to three down-draft carburetors 43. These carburetors 43 receive fuel from the fuel tank previously referred to in any well-known manner.

The charge thus formed is then transferred to an intake manifold (not shown) which is affixed to a side of the crankcase assembly 34 and which transfers the charge to the crankcase chambers through reed-type check valves. It should be noted that the carburetors 43 and plenum chamber 42, as well as the inlet to the intake manifold 44, have their centers lying on one side of a longitudinally extending center plane of the watercraft 11.

The charge which has been delivered to the crankcase chambers of the engine through the induction system 39 is further compressed in the crankcase chambers and then is transferred to the area above the pistons in the cylinder bores 36 through a known type of scavenging system. The charge then is fired by the spark plugs and causes the combustion to occur, which powers the engine 25.

The exhaust gases are discharged through exhaust ports formed in the side of the cylinder block 35 to a water-cooled exhaust manifold, indicated generally by the reference numeral 46. This exhaust manifold 46 terminates in a forwardly facing exhaust discharge opening. This opening communicates with an exhaust conduit indicated generally by the reference numeral 47 and which includes a generally C-shaped pipe section 48 that is comprised of a unitary inner pipe 49 (FIG. 3) that has an inlet opening 51 that communicates directly with the outlet opening of the exhaust manifold 46. This inner pipe 49 defines a gas flow path indicated at G.

The inner pipe 49 is surrounded by an outer pipe 52. The inner diameter of the outer pipe 52 is greater than the outer diameter of the inner pipe 49 so as to define a water cooling jacket 53 therebetween which is filled with coolant which is delivered to it in a manner to be described.

In this regard and as is typical in this art, the engine 25 is provided with a water-cooling system. The cooling system includes a pump for pumping water from the body of water in which the watercraft is operating. The jet propulsion unit 27 and specifically its impeller 29 may act as such a pump by drawing off a portion of the water pumped by it as is common in this art. The total coolant flow through this system will be described later by reference to FIG. 6. However, the coolant pumped by the pump is delivered to a distributor 54 that has a plurality of outlets including an outlet conduit 55 which is connected by a conduit shown schematically in FIG. 3 and which delivers the water to the cooling jacket 53 of the C-shaped pipe section 48 through an inlet nipple 50.

The inner pipe 49 communicates with an expansion chamber, indicated generally by the reference numeral 56, which lies along the side of the engine 25 opposite the induction system described and generally vertically above the engine. This expansion chamber 56 is formed by an inner pipe 57 which has a flange 58 at its forward end that is connected to a discharge flange 59 of the inner pipe 49 by means of an elastic sleeve 61 and a pair of hose-type clamps 62 and 63. This connection permits expansion and contraction due to thermal loads without adversely affecting the sealing of the exhaust gas flow.

An outer housing of the expansion chamber 56 is comprised of an outer tube 64 to which a forward end closure 65 is affixed by threaded fasteners 66. Again, a water cooling jacket, indicated generally by the reference numeral 67, is provided between the inner pipe 57 and the outer tube 64. The end closure 65 is affixed in sealing relationship to the rear portion of the outer tube 52 of the front C-shaped tube 48 by means of a hose clamp 68 or the like. As a result, integrity of the cooling jackets 53 and 67 is ensured with this construction.

The expansion chamber 56 has a slightly larger effective area than the C-shaped inner pipe 49 so as to achieve some silencing function. It should be noted that the inner pipe 57 of the expansion chamber 56 has a reduced diameter end portion 69 which terminates short of the downstream end of the outer pipe 64. This outer pipe 64 has a downwardly curved discharge section 71 which defines a chamber 72 that exists between the downstream inner pipe end 69 and a discharge outlet 73 of the expansion chamber 56.

A flexible pipe 74 has its inlet end in sealing engagement with the discharge end 73 of the expansion chamber 56 and extends rearwardly in the hull as shown in FIGS. 1 and 2 to discharge the exhaust gases to a water trap device 75. The water trap device 75 is disposed on one side of the aforenoted tunnel which contains the jet propulsion unit 27, this tunnel being indicated in FIG. 2 by the reference numeral 76.

A trap pipe 77 extends from the water trap device vertically upwardly and crosses over the top of the tunnel 76 and beneath the rear portion of the seat cushion 17. This trap pipe 77 terminates in a discharge opening that communicates with the inner surface of the tunnel 76 so that the exhaust gases will be discharged to the atmosphere through the tunnel 76. This provides a neat appearance and also will ensure that the exhaust gases will not soil the exterior of the hull 12. The discharge opening of the trap pipe 77 may be disposed so that it is at least partially submerged under all running conditions of the watercraft to provide additional silencing. However, the water trap device 75 will ensure that water cannot flow into the engine through the exhaust conduit 47.

Figure 3:
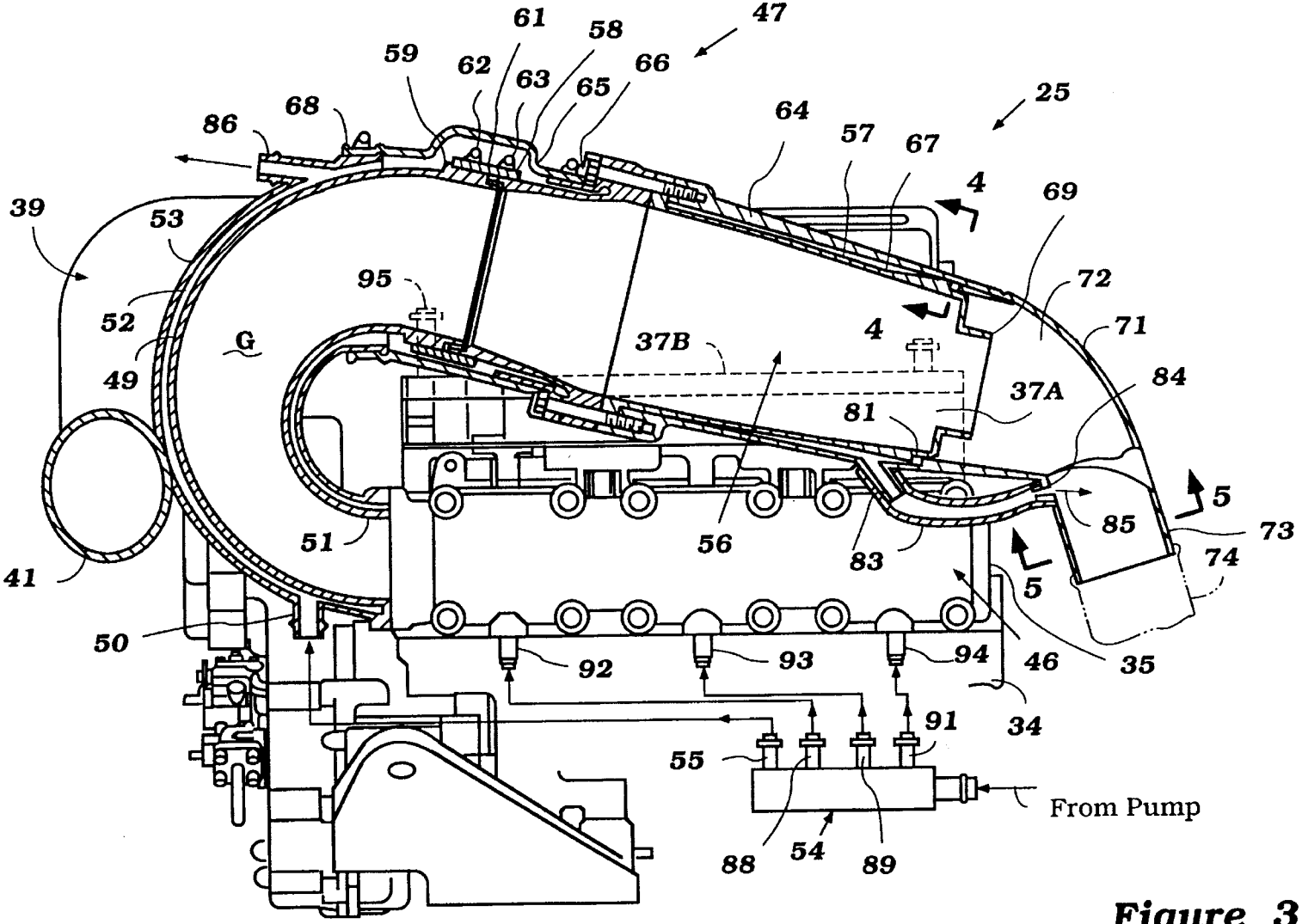
FIG. 3 is an enlarged side elevational view showing the engine and the forward portion of the exhaust system, with the exhaust system being shown in cross section.
Figure 5:
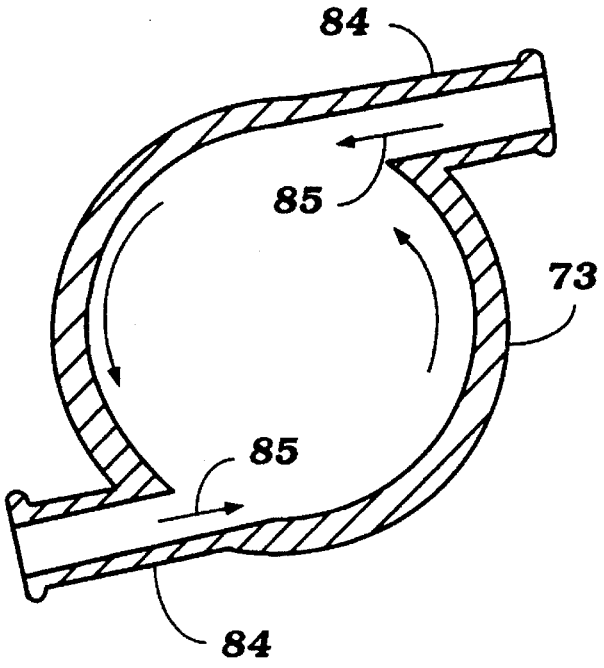
FIG. 5 is an enlarged cross-sectional view taken along the line 5—5 of FIG. 3.
Figure 4:
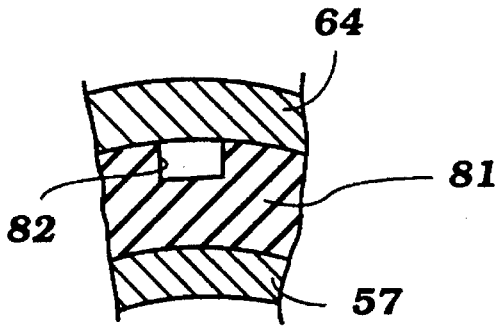
FIG. 4 is an enlarged cross-sectional view taken along the line 4—4 of FIG. 3.

The flow of coolant through the engine and through the cooling jackets 53 and 67 will now be described by particular reference to FIGS. 3–6. Referring first to FIGS. 3 and 4, it should be noted that the downstream end of the cooling jacket 67 of the expansion chamber 56 is sealed by means of an annular seal 81. This seal 81 is provided with one or more slots 82 so that a portion of the water from the expansion chamber cooling jacket 67 may flow into the section 72 formed downstream of the discharge end 69 of the inner pipe 57. This small amount of water will mix with the exhaust gases and provide cooling and silencing.

However, it is desirable that the major portion of this water in the cooling jacket 67 is not discharged in this area but rather is discharged either into the exhaust conduit 47 well downstream of the discharge end 69 of the inner tube 57 for mixing with the exhaust gases and further cooling of them or discharged externally.

For the former purpose, the outer tube 64 of the expansion chamber 56 is provided with an outlet nipple 83 which has a substantially larger effective flow area than the slot or slots 82. A Y-shaped conduit 84 delivers coolant from this nipple 83 to a pair of tangentially disposed water nipples 85 formed on diametrically opposite sides of the outlet pipe 73 of the expansion chamber 56 at a point downstream of the chamber 72. This water flows as shown by the arrows 85 in FIGS. 3 and 5 around the outer periphery of the pipe section 73 so as to cool this section and then will gradually mixes with the exhaust gases as the exhaust gases flow downwardly into the flexible exhaust pipe 74. Therefore, this water will not be likely to go into the inner pipe outlet end 69 and flow toward the engine. In addition, the downward inclination of the expansion chamber 56 further ensures that water cannot flow to the engine through the exhaust system.

In addition to this discharge path through the exhaust conduit 36, there is provided a further discharge of cooling water from the cooling jackets 53 and 67 directly back to the body of water in which the watercraft is operating. This is provided by a further discharge nipple 86 that is formed in the C-shaped tube section 48 upstream of its connection to the expansion chamber cooling jacket 57. This nipple 86 communicates with a conduit (not shown) that discharges through the side of the hull 12 directly into the body of water in which the watercraft 11 is operating. This discharge opening may be positioned in such a location that it can be visible to the operator of the watercraft 11 so that he can ensure that the engine is being cooled by coolant flowing through the engine cooling jacket.

Figure 6:
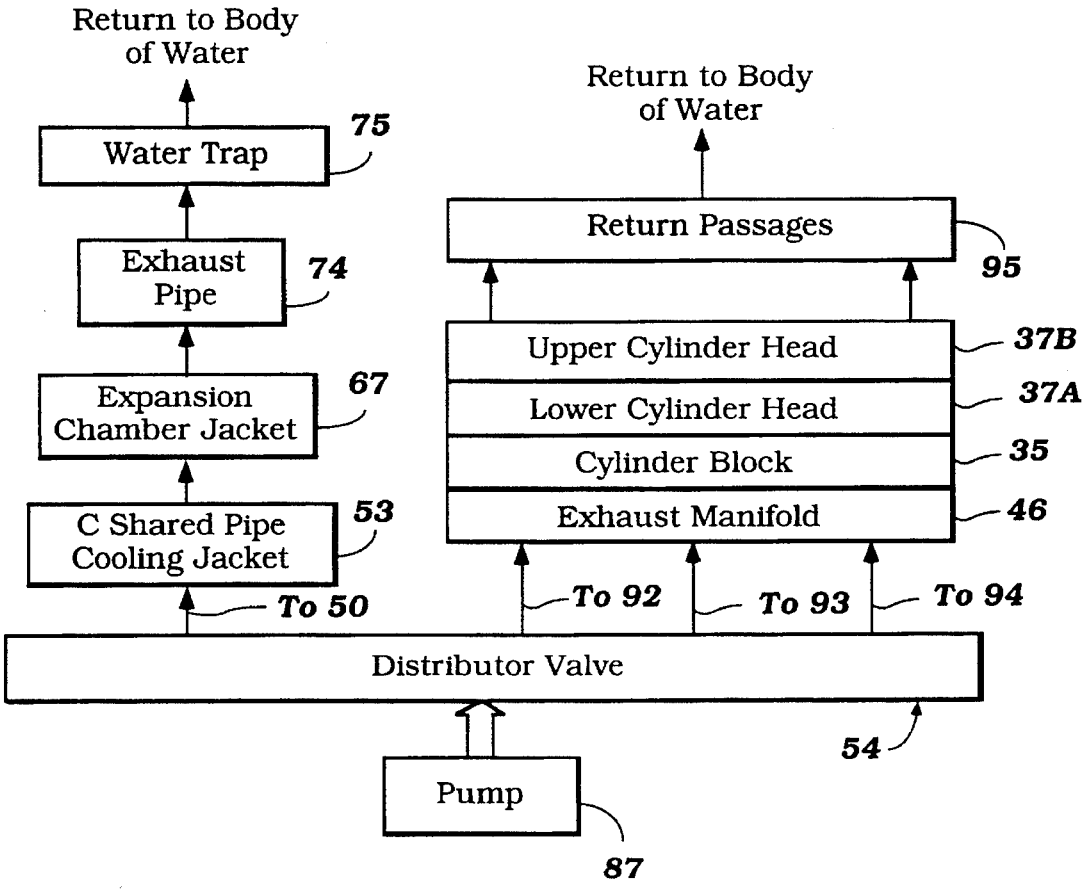
FIG. 6 is a block diagram showing the path of coolant flow through the engine and exhaust system cooling jackets.

FIG. 6 shows the total coolant flow through the system and indicates a pump, shown schematically and identified by the reference numeral 87, which delivers coolant to the distributor 54 which is also shown in FIG. 3. The distributor 54 has, as noted, a first discharge nipple 55 that delivers coolant to the exhaust system cooling jackets 53 and 67 as shown in FIG. 6 and as previously described.

In addition, there are provided three further discharge nipples 88, 89 and 91 each of which discharges coolant directly to a cooling jacket formed in the exhaust manifold 46. The exhaust manifold 46 has inlet nipples 92, 93, and 94 which receive coolant from the distributor valve outlet nipples 88, 89, and 91 through flexible conduits shown schematically in FIG. 3. By providing three inlet nipples for the exhaust manifold 46, it is possible to deliver the coolant directly to the runner sections (not shown) of the exhaust manifold 46 which extend from the exhaust ports of the cylinder block 35 directly back to the collector section of the exhaust manifold 46.

After the coolant has passed through the exhaust manifold cooling jacket, it is delivered to the cylinder block cooling jacket and the cylinder head cooling jackets in that order. The cylinder head assembly 37 is divided into a lower portion 37A and an upper portion 37B and each has its respective cooling jacket as shown schematically in FIG. 6. This water that has passed through the engine cooling jacket is then discharged through a pair of discharge nipples 95 (FIG. 3) that are formed in the upper end of the cylinder head member 37B and then back to the body of water in which the watercraft is operating through any suitable conduit. Thus, it should be readily apparent that the exhaust system is adequately cooled, the exhaust gases are silenced by this cooling and by the expansion chamber and water trap device and also water is precluded from entering the engine through its exhaust system.

Figure 8:
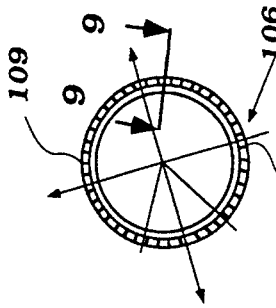
FIG. 8 is a cross-sectional view taken along the line 8—8 of FIG. 7.
Figure 9:
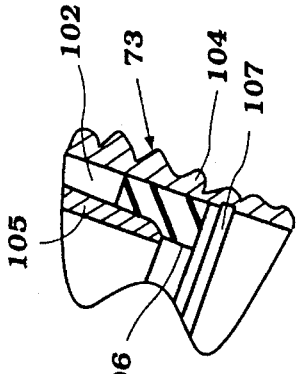
FIG. 9 is an enlarged cross-sectional view taken along the line 9—9 of FIG. 8.
Figure 7:
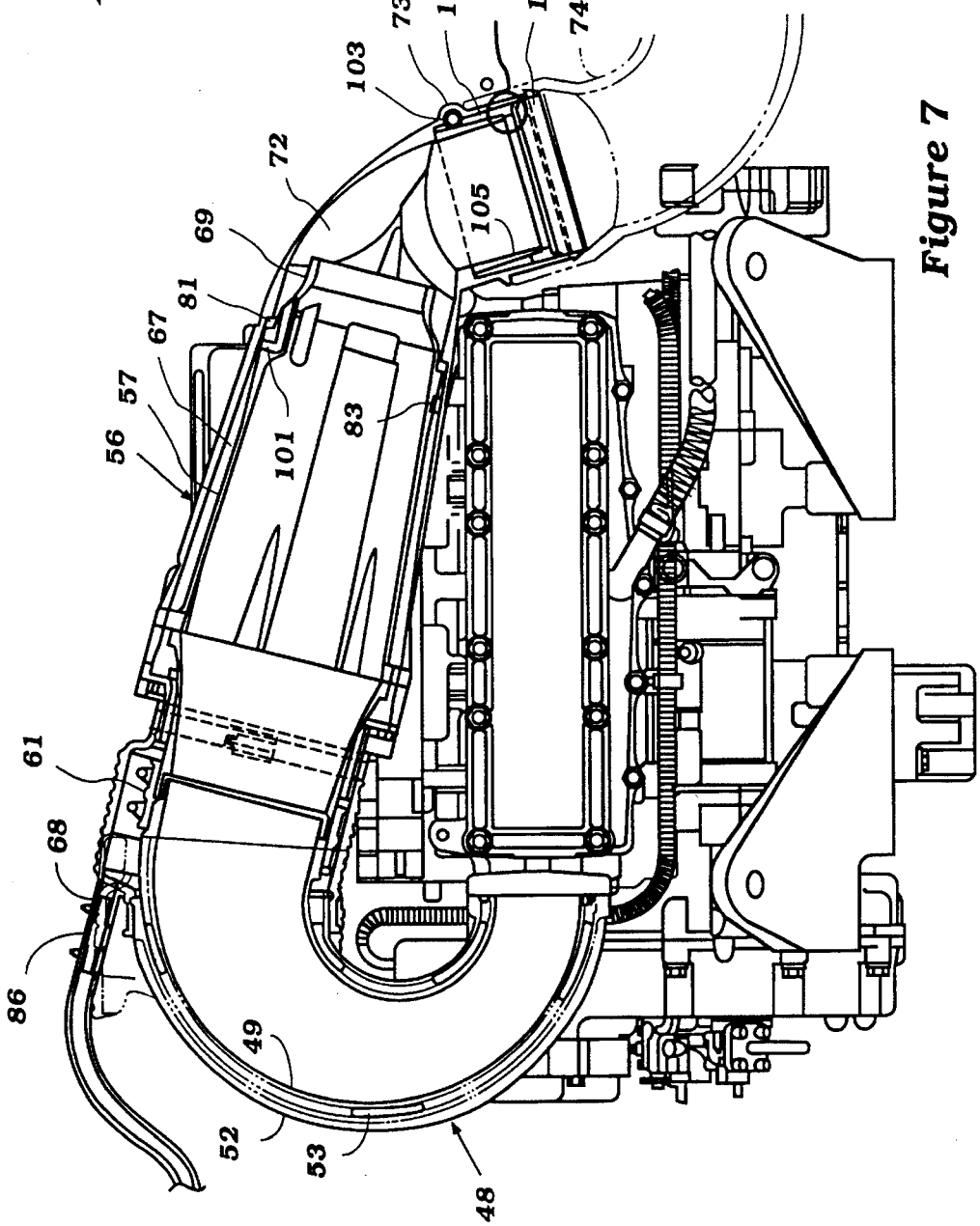
FIG. 7 is a side elevational view, with portions broken away similar to FIG. 3, but shows another embodiment of the invention.

FIGS. 7–9 show another embodiment of the invention which is generally the same as the embodiment previously described and where the construction is the same or substantially the same, those components have been identified by the same reference numerals and will not be described again, except insofar as is necessary to understand the construction and operation of this embodiment.

Primarily this embodiment differs from the previously described embodiment in two regards. First, the seal 81 at the downstream end of the expansion chamber cooling jacket 67 has no flow openings in it. Rather, a small bypass passageway 101 is formed that extends only from the upper portion of the cooling jacket 67 directly to the outer periphery of the discharge end 69 of the inner pipe 57 and through this pipe so as to cool it. This coolant will flow around the discharge end 69 and enter the chamber 72 for mixture with the exhaust gases. This is a relatively small amount of water flow.

There is also the telltale direct discharge provided by the nipple 86 as in the previously described embodiment.

In this embodiment, however, the discharge nipple 83 of the expansion chamber cooling jacket 67 does not flow directly into the exhaust gases at the discharge end 73 of the expansion chamber device 56. Rather, the expansion chamber device discharge end 73 is formed with a cooling jacket, indicated generally by the reference numeral 102 and which is formed in a manner as will now be described.

Coolant is delivered to this cooling jacket 83 from the discharge nipple 83 through a flexible conduit and inlet nipple 103 for the cooling jacket 102. As may be seen, the discharge end 73 is formed with an outer portion 104 in which an inner tube 105 of a smaller diameter is press fit so as to form the cooling jacket 102. An annular seal 106 is retained at the lower end of the cooling jacket 102 by a retainer ring 107. The seal 106 is provided with slots 108 and 109 that are disposed on the top and bottom sides of the construction and which permit the water from this additional cooling jacket 102 to flow into the flexible exhaust pipe 74 so as to cool it. This point of discharge is well downstream of the discharge end 69 of the inner pipe 57 of the trap section 56 and further ensures that water cannot enter the engine through the exhaust system.

From the foregoing description it should be readily apparent that the described embodiments of the invention provide very effective water cooling for the exhaust conduit and engine and also ensure that some of the cooling water for the exhaust system may be mixed with the exhaust gases for discharge back into the body of water in which the watercraft is operating without the danger of this coolant being permitted to flow to the engine through its exhaust system. Of course, the foregoing description is that of preferred embodiments of the invention and various changes and modifications may be made without departing from the spirit and scope of the invention, as defined by the appended claims.

We claim:

1. An exhaust system for a watercraft powered by a water cooled internal combustion engine having at least one exhaust port, an exhaust conduit extending from said exhaust port through said hull to an outlet for discharge of exhaust gases from said engine to the atmosphere, said exhaust conduit having a double-wall section with the area between said double walls forming a cooling jacket through which water is circulated, the inner member of said double-walled portion forming an exhaust gas flow path through which exhaust gases pass in their path from said exhaust port to said outlet, the downstream end of said inner member terminating short of the outer member so that a portion of said outer member extends beyond the downstream end of said inner member, seal means for sealing at least the portion of said cooling jacket adjacent said downstream end of said inner member, and means for discharging a major portion of water from said cooling jacket into said exhaust conduit downstream of said inner member downstream end not contiguous to said end.

2. The exhaust system for a watercraft powered by a water-cooled internal combustion engine as set forth in claim 1, wherein the double-walled section is downwardly inclined so that the downstream end of the inner member is disposed vertically beneath the inlet thereto from the exhaust port.

3. The exhaust system for a watercraft powered by a water-cooled internal combustion engine as set forth in claim 2, wherein the double-wall section is positioned on a side of the engine.

4. The exhaust system for a watercraft powered by a water-cooled internal combustion engine as set forth in claim 3, wherein the exhaust port communicates with an exhaust manifold formed on the side of the engine and which communicates with the double-wall section through a vertically upwardly extending C-shaped section.

5. The exhaust system for a watercraft powered by a water-cooled internal combustion engine as set forth in claim 4, wherein the exhaust conduit includes a water trap device positioned downstream of the point where the water from the cooling jacket is introduced into the exhaust conduit.

6. The exhaust system for a watercraft powered by a water-cooled internal combustion engine as set forth in claim 5, further including a trap pipe forming a portion of the exhaust conduit and extending, vertically upwardly from the water trap device and transversely across the watercraft beneath a seat positioned at the rear end thereof and terminating in a downwardly extending section which forms the outlet.

7. The exhaust system for a watercraft powered by a water-cooled internal combustion engine as set forth in claim 1, further including means for discharging a portion of the water from the cooling jacket into the exhaust conduit contiguous to the downstream end of the inner member.

8. The exhaust system for a watercraft powered by a water-cooled internal combustion engine as set forth in claim 7, wherein the further coolant discharge is disposed substantially upstream of the first mentioned means for discharging water from the cooling jacket into the exhaust conduit.

9. The exhaust system for a watercraft powered by a water-cooled internal combustion engine as set forth in claim 8, wherein the further discharge discharges a substantially lesser amount of water into the exhaust conduit than the first mentioned means.

10. The exhaust system for a watercraft powered by a water-cooled internal combustion engine as set forth in claim 9, further including a third discharge conduit for discharging water from the cooling jacket directly back to the body of water in which the watercraft is operating independently of the exhaust conduit.

11. The exhaust system for a watercraft powered by a water-cooled internal combustion engine as set forth in claim 9, wherein the double-walled section is downwardly inclined so that the downstream end of the inner member is disposed vertically beneath the inlet thereto from the exhaust port.

12. The exhaust system for a watercraft powered by a water-cooled internal combustion engine as set forth in claim 11, wherein the double-wall section is positioned on a side of the engine.

13. The exhaust system for a watercraft powered by a water-cooled internal combustion engine as set forth in claim 12, wherein the exhaust port communicates with an exhaust manifold formed on the side of the engine and which communicates with the double-wall section through a vertically upwardly extending C-shaped section.

14. The exhaust system for a watercraft powered by a water-cooled internal combustion engine as set forth in claim 13, wherein the exhaust conduit includes a water trap device positioned downstream of the point where the water from the cooling jacket is introduced into the exhaust conduit.

15. The exhaust system for a watercraft powered by a water-cooled internal combustion engine as set forth in claim 14, further including a trap pipe forming a portion of the exhaust conduit and extending vertically upwardly from the water trap device and transversely across the watercraft beneath a seat positioned at the rear end thereof and terminating in a downwardly extending section which forms the outlet.

16. The exhaust system for a watercraft powered by a water-cooled internal combustion engine as set forth in claim 1, wherein means for discharging the water from the cooling jacket into the exhaust conduit first discharges the water into a second cooling jacket circling a portion of the exhaust conduit downstream of the downstream end of the inner member and then from this additional cooling jacket into the exhaust conduit.

17. The exhaust system for a watercraft powered by a water-cooled internal combustion engine as set forth in claim 16, wherein the second cooling jacket is disposed substantially downstream of the downstream end of the inner member.

18. The exhaust system for a watercraft powered by a water-cooled internal combustion engine as set forth in claim 17, wherein the exhaust conduit includes a flexible section disposed immediately adjacent the downstream end of the second cooling jacket.

19. The exhaust system for a watercraft powered by a water-cooled internal combustion engine as set forth in claim 18, further including means for discharging a portion of the water from the cooling jacket into the exhaust conduit contiguous to the downstream end of the inner member.

20. The exhaust system for a watercraft powered by a water-cooled internal combustion engine as set forth in claim 19, wherein the further coolant discharge is disposed substantially upstream of the first mentioned means for discharging water from the cooling jacket into the exhaust conduit.

21. An exhaust system for a watercraft powered by a water cooled internal combustion engine having at least one exhaust port, an exhaust conduit extending from said exhaust port through said hull to an outlet for discharge of exhaust gases from said engine to the atmosphere, said exhaust conduit having a double-wall portion with the area between said double walls forming a cooling jacket through which water is circulated, the inner member of said double-walled portion forming an exhaust gas flow path through which exhaust gases pass in their path from said exhaust port to said outlet, means forming a seal between said inner member and the outer members at the downstream end of said cooling jacket, and means for returning a major portion of the water from said cooling jacket to said exhaust conduit downstream of said seal not contiguous to said seal.

22. The exhaust system for a watercraft powered by a water-cooled internal combustion engine as set forth in claim 21, wherein the means for returning a portion of the water to the exhaust conduit introduces the water in a tangential direction to the exhaust conduit so that the water will flow around the exhaust conduit.

23. The exhaust system for a watercraft powered by a water-cooled internal combustion engine as set forth in claim 22, wherein the water is discharged to the exhaust conduit substantially downstream of the downstream end of the inner member.

24. The exhaust system for a watercraft powered by a water-cooled internal combustion engine as set forth in claim 21, wherein the means for discharging the coolant to the exhaust conduit includes a second cooling jacket disposed substantially downstream of the first cooling jacket.

25. The exhaust system for a watercraft powered by a water-cooled internal combustion engine as set forth in claim 24, wherein the exhaust conduit includes a flexible section disposed immediately adjacent the downstream end of the second cooling jacket.

* * * * *

UNITED STATES PATENT AND TRADEMARK OFFICE
CERTIFICATE OF CORRECTION

PATENT NO. : 5,531,620

DATED : July 2, 1996

INVENTOR(S): Ozawa et al.

It is certified that error appears in the above-identified patent and that said Letters Patent is hereby corrected as shown below:

Claim 1, line 4, please change "said hull" to --a hull of the watercraft--
Claim 2, line 5, please change "the inlet" to --an inlet--
Claim 5, line 4, please change "the point" to --a point--
Claim 6, line 4, please delete ","
Claim 6, line 11, please change "the downstream" to --a downstream--
Claim 11, line 5, please change "the inlet" to --an inlet--
Claim 14, line 4, please change "the point" to --a point--
Claim 18, line 4, please change "the downstream to --a downstream--
Claim 21, line 4, please change "said hull" to --a hull of the watercraft--
Claim 21, line 12, please change "the downstream" to --a downstream--
Claim 21, line 13, please change "returning" to --discharging--
Claim 23, line 4, please change "the downstream" to --a downstream--

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*